US008755727B2

(12) United States Patent
Kosasa

(10) Patent No.: US 8,755,727 B2
(45) Date of Patent: Jun. 17, 2014

(54) SURFACE PROCESSING APPARATUS AND IMAGE FORMATION SYSTEM

(75) Inventor: Hideaki Kosasa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 13/613,844

(22) Filed: Sep. 13, 2012

(65) Prior Publication Data

US 2013/0070267 A1 Mar. 21, 2013

(30) Foreign Application Priority Data

Sep. 16, 2011 (JP) ..... 2011-203590

(51) Int. Cl.
*G03G 15/20* (2006.01)

(52) U.S. Cl.
CPC ..... *G03G 15/2082* (2013.01); *G03G 15/2078* (2013.01); *G03G 2215/00805* (2013.01)
USPC ..... 399/334; 399/69; 399/341

(58) Field of Classification Search
CPC ..... G03G 15/2082; G03G 15/2078; G03G 2215/00805; G03G 2215/00801
USPC ..... 399/69, 334, 341, 342
See application file for complete search history.

(56) References Cited

U.S. PATENT DOCUMENTS

| | | | | |
|---|---|---|---|---|
| 7,024,149 | B2 | 4/2006 | Kito et al. | |
| 7,783,242 | B2 | 8/2010 | Chigono et al. | |
| 8,385,806 | B2 * | 2/2013 | Morikawa | 399/341 |
| 2004/0096250 | A1 | 5/2004 | Kito et al. | |
| 2007/0147917 | A1 | 6/2007 | Chigono et al. | |
| 2012/0269542 | A1 | 10/2012 | Kosasa | |

FOREIGN PATENT DOCUMENTS

| | | | |
|---|---|---|---|
| JP | 2001-130150 | A | 5/2001 |
| JP | 2004-170548 | A | 6/2004 |
| JP | 2007-086747 | A | 4/2007 |

* cited by examiner

*Primary Examiner* — Hoang Ngo
(74) *Attorney, Agent, or Firm* — Fitzpatrick, Cella, Harper & Scinto

(57) ABSTRACT

A surface processing apparatus includes a heater and a controller for controlling a heating of a sheet. The controller determines a difference between a position, on the sheet, of an image indicated by original image information and a position, on the sheet, of the actually formed image on the sheet indicated by outer configuration information of the sheet and the actual image information. The controller corrects inputted heating position information, for the heater, on the basis of information of the difference, and controls the heating of the heating means in accordance with the corrected heating position information.

7 Claims, 9 Drawing Sheets

SURFACE PROCESSING APPARATUS AND IMAGE FORMATION SYSTEM

FIELD OF THE INVENTION AND RELATED ART

The present invention relates to a surface processing apparatus capable of controlling the surface properties of the selected sections of a print to be processed, by heating the selected sections of the print to be processed, through a film. It also relates to an image formation system equipped with the surface processing apparatus.

Generally speaking, the area of a print which is covered with ink, developer, or the like is different in gloss from the area of the print which is not covered with ink, developer, or the like. Thus, prints are different in gloss from each other, depending on their printing area ratio. Thus, various methods for making the entirety of the surface of a print uniform in gloss have been proposed. One of the methods is to process a print, for example, to entirely cover the image bearing surface of the print with a transparent layer, after the formation of the print by an image forming apparatus.

Further, in recent years, various methods for controlling the level of glossiness of a print output by an image forming apparatus have been introduced. For example, in the field of offset printing, it became possible to make an image forming apparatus to output prints different in glossiness, by using a method such as the following one. That is, a print is made with the use of color inks, and then, UV-curable transparent ink is applied to the specific sections of the print by offset printing. Then, the entirety of the image bearing surface of the print is exposed to UV-rays to cure the UV-curable ink. This method can make an image forming apparatus output a print, the selected section (photograph section, title sections, or the like) of which is higher in gloss, thereby offering a significant amount of visual effect, than the rest of the print.

Also in recent years, demands have increased for a print with added value, for example, a print, the entirety, or selected sections of which are higher in gloss than an ordinary print. One of the methods for making an image forming apparatus output a print which looks like a photograph, that is, a print which is higher in gloss across the entirety of its image bearing surface than an ordinary print, is disclosed in Japanese-Laid open Patent application 2007-086747. According to this patent application, the surface of a print, which bears a toner image, is reheated with the use of a very smooth endless belt so that the toner image is remelted. Then, the toner image on the sheet of a recording medium of the print is cooled while being kept in contact with the belt. Thus, the texture (smoothness) of the belt is transferred onto the surface of the toner image. This method, however, is problematic in that it can control the gloss of the entirety of a print, but it is difficult for this method to control the gloss of only selected sections of the print.

Japanese Laid-open Patent Application 2004-170548 discloses a method which controls the gloss of the selected sections of the image bearing surface of a print with the use of a thermal head. According to this patent application, the selected sections of a print are heated with the use of a thermal head. Then, the print is conveyed between an endless belt, and a pressure roller, which is kept pressed upon the belt by the pressure roller. Then, the print is cooled while being kept pressed upon the endless belt. Thus, the surface properties (texture) of the endless belt are transferred onto the selected sections (heated sections) of the print. Further, Japanese Laid-open Patent 2004-170548 discloses a method for preventing a thermal head from failing to align with the selected sections of a print to be processed, by controlling the speed at which the endless belt is circularly moved, based on the positional information obtained by a position sensor.

It is sometimes required to produce a print which is not only glossy, but also, appears metallic, for example, gold or silver colored. Japanese Laid-open Patent Application 2001-130150 discloses a thermal transfer sheet for a thermal printer (thermal transfer printer) which is for producing a print which has metallic gloss.

The inventors of the present invention found, through earnest research, that heating the selected sections of a print with the use of a thermal head and thin film is suitable for giving a preset amount of gloss to the selected sections of a print formed with the use of an electrophotographic image formation method. This method can heat any point or section of a print by electrically controlling a thermal head. More specifically, an object (print) to be processed is such a print that is a combination of a sheet of recording medium and a toner image formed on the sheet with the use of an electrophotographic image formation method. Therefore, the gloss of any point or section of the print can be changed by melting the point or section of the print to be changed in gloss, by heating the point or section through a sheet of film, cooling the print together with the sheet of film, and separating the print from the sheet of film.

For example, if it is desired to give a part of a character, for example, a letter A, a three dimensional appearance by changing (increasing) the gloss of part of the character, it is required to highly precisely align the sheet of the recording medium on which the character is present, with a heating means. Needless to say, not only is this highly precise alignment required in a case where the object to be processed is a character, but also, in a case where the object to be processed is a photographic image. Further, the highly precise alignment between the print and a heating means is required in a case where an image with an unusual color, for example, an image of gold, silver, or the like color, is formed on the print by processing the print after the formation of the print.

Most of the recent image outputting apparatuses such as an electrophotographic printer, a thermal transfer print, or the like, output images based on digital data of an image to be formed. However, the actual position of the image formed on a sheet of the recording medium relative to the sheet of the recording medium does not perfectly match the theoretical position of the image relative to the sheet of the recording medium which is indicated by the digital data of the image to be formed.

For example, an electrophotographic image forming apparatus forms an image while conveying a sheet of the recording medium. Therefore, the position in which the image being formed results on the sheet of the recording medium is not always the theoretical position on the sheet of the recording medium which the digital data of the image to be formed indicates, because of the fluctuation in the recording medium conveyance speed, the difference in preciseness among the image forming stations, etc. Thus, an electrophotographic image forming apparatus sometimes outputs a print, the toner image of which is linearly and/or rotationally offset, deformed, and/or different in size from the theoretically correct one.

Further, an electrophotographic image forming apparatus applies heat to a sheet of the recording medium and the unfixed toner image thereon to fix the unfixed toner image to the sheet of recording medium. Therefore, if the recording medium is paper, moisture evaporates from the sheet of the recording medium (paper), causing thereby the sheet to shrink. The amount by which the sheet of recording medium (paper) shrinks is affected by the alignment of paper fiber, the paper fiber density, and/or the like factors. Therefore, it is virtually impossible to precisely predict the shrinkage. In addition, it sometime occurs that as a print is left unattended, moisture penetrates again into the sheet of paper of the print, expanding thereby the sheet by an unpredictable amount. Whether or not this phenomenon occurs depends on the condition of the environment in which the print is left. In other words, the position of the image on a sheet of the recording medium relative to the sheet of the recording medium is affected by the expansion or shrinkage of the sheet of the recoding medium. Therefore, the position of the toner image on a sheet of the recording medium relative to the sheet is likely to be different from the one indicated by the digital data of the image to be formed.

Therefore, in a case where the selected sections of a print are to be changed in gloss and/or an image of unusual color (gold, silver, or the like color) is to be formed on the preexisting image on the print, it is difficult to precisely align the heating means with the selected sections of a print to be changed in gloss and/or overlaid with an image of unusual color, because the actual position of the image on the print relative to the sheet of the recording medium of the print, is different from the theoretical position on a sheet of recording medium, which the data of the image to be formed indicates.

The aforementioned Japanese Laid-open Patent Application 2004-170548 does not disclose a method for aligning a heating means with the selected sections of a print, based on the position of the selected sections detected by a position sensor.

SUMMARY OF THE INVENTION

Therefore, an object of the present invention is to provide a surface processing apparatus and an image formation system which can precisely align their heating means with the image on a print to be processed, when it is necessary to change a property of the selected sections of the surface of the image on the recording medium of the print to be processed.

According to an aspect of the present invention, there is provided a surface processing apparatus including feeding means for feeding a medium-to-be-processed, heating means for selectively heating different, with respect to a direction substantially perpendicular a feeding direction of the medium-to-be-processed, positions of a surface of the medium-to-be-processed through a film, wherein the heating means partially heats the surface of the medium-to-be-processed on which an image is formed in accordance with original image information, while the medium-to-be-processed is being fed by the feeding means, the apparatus comprising control means for controlling a heating of the heating means; original image information inputting means for inputting the original image information to the control means; reading means, provided upstream of a heating portion for heating the medium-to-be-processed by the heating means, for reading an outer configuration of the medium-to-be-processed and an image formed on the medium-to-be-processed and for inputting to the control means outer configuration information indicative of the outer configuration of the medium-to-be-processed and actual image information indicative of the image on the medium-to-be-processed; and heating position information inputting means for inputting to the control means heating position information indicative of a heating position on the medium-to-be-processed by the heating means; wherein the control means determines a difference between a position, on the medium-to-be-processed, of the image indicated by the original image information and a position, on the medium-to-be-processed, of the actually formed image on the medium-to-be-processed indicated by the outer configuration information and the actual image information, and for correcting inputted heating position information on the basis of information of the difference, and for controlling the heating of the heating means in accordance with the corrected heating position information.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the present invention is described in detail in the form of a surface processing apparatus in accordance with the present invention, and an image formation system having the surface processing apparatus, with reference to the appended drawings.

Embodiment 1

1. Basic Structure of Surface Processing Apparatus

Figure 1:
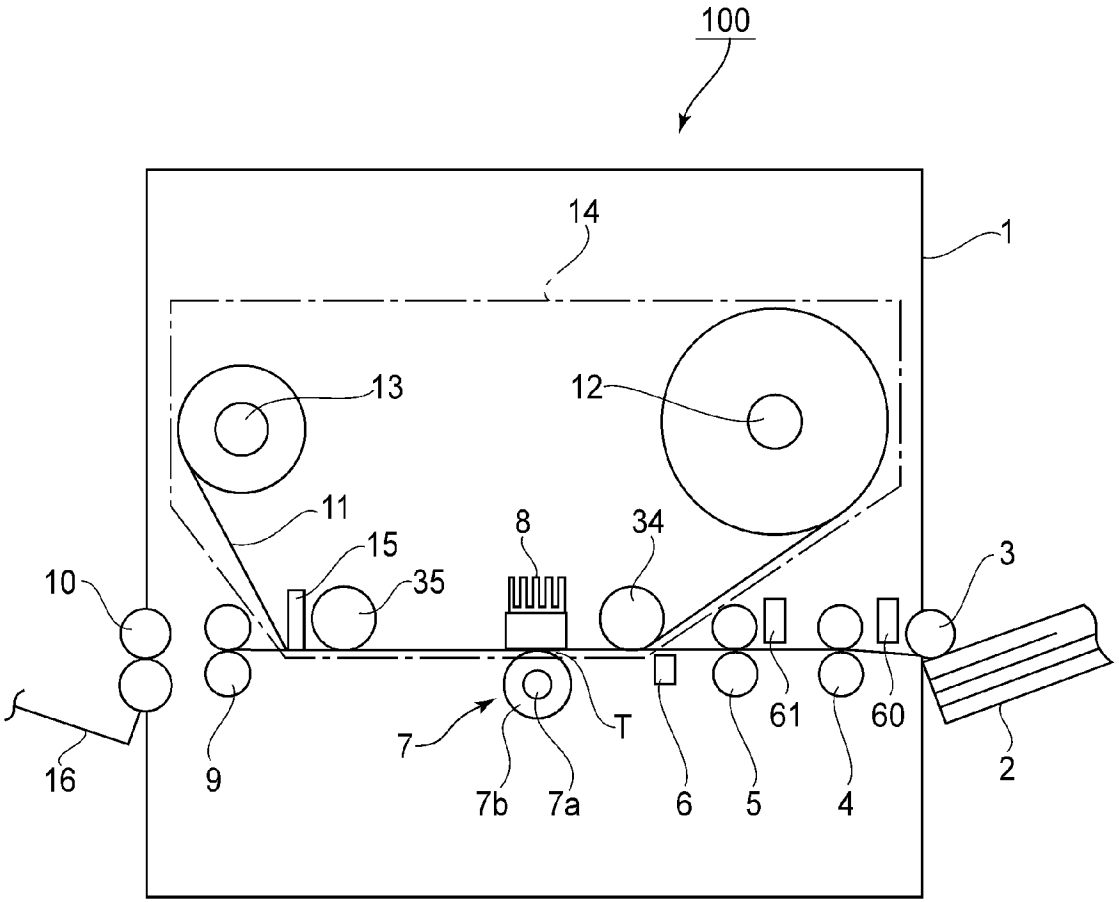
FIG. 1 is a schematic sectional view of the surface processing apparatus in the first embodiment of the present invention, at a vertical plane perpendicular to the recording medium conveyance direction of the apparatus.

FIG. 1 is a schematic sectional view of the surface processing apparatus 100 in the first embodiment of the present invention. The medium S to be processed by the surface processing apparatus 100 in this embodiment is such a print that is a combination of a sheet of a recording medium and an image formed on the sheet of the recording medium with the use of thermally meltable toner. Thus, the surface processing apparatus 100 processes the surface of the print to alter the print in surface properties.

The surface processing apparatus 100 has: a main assembly 1; a cassette 2 which stores in layers multiple prints S to be processed; a feed roller 3 which feeds each print S in the cassette 2 into the main assembly 1 while separating it from the rest; a pair of print conveyance rollers 4 which convey the print S, while keeping the print S pinched by the pair; a pair of print conveyance rollers 9 which convey the print S, while keeping the print S pinched by the pair; etc. Further, the surface processing apparatus 100 has a sensor 6 for detecting the leading edge of the print S (medium to be processed), when the print S is conveyed to the processing station T. It has also a pair of registration rollers 5 which corrects the attitude of each print S sent from the pair of recording medium conveyance rollers 4, and also, the timing with which the print S is conveyed.

Further, the surface processing apparatus 100 has a platen roller 7 and a thermal head 8. The platen roller 7 is a platen in the form of a roller, and is a component for backing up the print S (medium to be processed). The thermal head 8 is a heating means of the contact type, and is capable of selectively heating various sections of the surface of the print S. The surface processing apparatus 100 is positioned so that when the print S is conveyed through the surface processing apparatus 100, its platen roller 7 and thermal head 8 (film 11) sandwich the print S. The platen roller 7 plays not only the role of backing up the film 11 (which will be described later in detail) and print S when the thermal head 8 is pressed against the selected sections of the print S through the film 11, but also, the role of conveying the print S. The thermal head 8 selectively heats various points of the surface of the print S, based on a gloss alteration pattern (information about points of a surface of print S to be heated, the heating pattern, gloss alteration data, data of image to be heated), which will be described later.

Further, the surface processing apparatus 100 has: the film 11 which is pressed upon the print S (medium to be processed), by the thermal head 8, and the selected points of which are heated by the thermal head 8; a take-up shaft 13 as a means for taking up the film 11; and a supply shaft 12, as a means for supplying the processing station T with film 11. The take-up shaft 13 is rotated by a motor M1 (FIG. 6) dedicated to the driving of the take-up shaft 13. The take-up shaft driving motor M1 can rotate the take-up roller 13 in the direction to unwind the film 11 from the supply shaft 12, which can be rotated in the direction to unwind the film 11 toward the take-up shaft 13. Incidentally, the surface processing apparatus 100 may be provided with a pressure applying means for applying to the supply shaft 12, such pressure that works in the direction opposite to the above-described direction, in order to prevent the film 11 from slacking.

Hereafter, the surface of the film 11, which comes into contact with a print S (medium to be processed) will be referred to simply as the "surface" of the film 11, and the opposite surface of the film 11 from its "surface" will be referred to as the "back surface". Further, the surface of the print S, with which the film 11 comes into contact, will be referred to simply as the "surface" of the medium S, and the opposite surface of the print S from the "surface" of the print S, that is, the surface of the print S, which comes into contact with the platen roller 7, will be referred to as the "back surface" of the print S.

Further, the surface processing apparatus 100 has a first film positioning roller 34 and a second film positioning roller 35, which are positioned so that they contact the "back surface" of the film 11. Further, the surface processing apparatus 100 has a separating member 15 for separating the film 11, which remains in contact with the print S (medium to be processed) after the film 11 has been heated by the thermal head 8 while being pressed upon the print S, from the print S. The supply shaft 12, the take-up shaft 13, the platen roller 7, the first film positioning roller 34, the second film positioning roller 35, and the separating member 15, are roughly parallel to each other. The film 11 is unwound from the supply shaft 12, is wrapped around a part of the peripheral surface of the first film positioning roller 34, and, is guided to the processing station T (compression nip), which is the area of contact (nip) between the film 11 and platen roller 7, and in which the film 11 is pressed upon the print S (medium to be processed) by the thermal head 8. Then, the film 11 is moved through the processing station T, is made to pass by the second film positioning roller 35, and is changed in direction by the separating member 15, is guided to the take-up shaft 13, and is wound up by the take-up shaft 13. This direction in which the film 11 is circularly moved will be referred to as the "normal direction". The direction in which the film 11 is circularly moved is roughly perpendicular to the lengthwise direction of the supply shaft 12, the take-up shaft 13, the platen roller 7, the first film positioning roller 34, the second film positioning roller 35, and the separating member 15. The direction in which the print S (medium to be processed) is conveyed through the processing station T, when it is processed, is the same as the direction in which the film 11 is moved. The first and second film positioning rollers 34 and 35 are rotatable, and keep the film 11 properly positioned. They are rotated by the movement of the film 11.

The surface processing apparatus 100 has also a pair of registration rollers 5, which are kept pressed upon each other. The registration rollers 5 are on the upstream side of the processing station T in terms of the direction in which the print S (medium to be processed) is conveyed. They are for correcting in attitude the print S before the print S is processed. They are rotationally driven by a registration roller driving motor M2 (FIG. 6) as a mechanical power source. They convey the print S after correcting the print S in attitude if the print S happens to be askew; if the print S is being conveyed askew, it is corrected in attitude as its leading edge strikes the area of contact (nip) between the pair of registration rollers 5.

Further, the surface processing apparatus 100 has a pair of conveyance rollers 4, which are kept pressed upon each other. The conveyance rollers 4 are on the upstream side of the pair of registration rollers 5 in terms of the direction in which the print S (medium to be processed) is conveyed. Further, the surface processing apparatus 100 has a pair of conveyance rollers 9, which are kept pressed upon each other. The conveyance rollers 9 are on the downstream side of the processing station T in terms of the direction in which the print S is conveyed. The pair of conveyance rollers 4 convey the print S to the pair of registration roller 5. The pair of conveyance rollers 9 convey the print S to an external delivery tray 16 of the surface processing apparatus 100 (which will be described later), or an additional processing station, after the gloss alteration of the print S.

In this embodiment, the pair of conveyance rollers 4, the pair of conveyance rollers 9, the pair of registration rollers 5, the platen roller 7, etc., make up the means for conveying the print S (medium to be processed).

Figure 9:
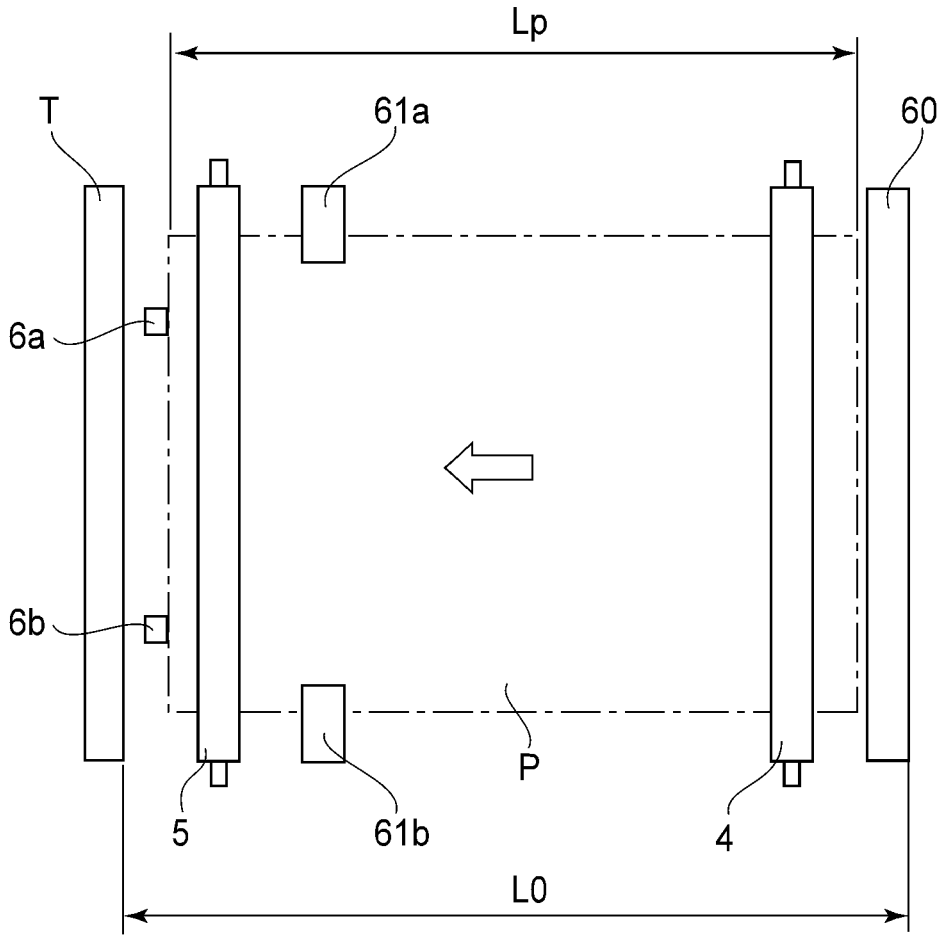
FIG. 9 is a schematic drawing for describing the sensor position of the surface processing apparatus in the first embodiment of the present invention.

Further, the surface processing apparatus 100 has a pair of sensors 6*a* and 6*b* (which hereafter will be referred to as "leading edge sensor" and are shown in FIG. 9) as means for detecting the presence or absence of print S (medium to be processed) (more specifically, leading or trailing edge of print S). In this embodiment, the sensors 6*a* and 6*b* for detecting the print S are on the downstream side of the pair of registration rollers 5 in terms of the direction in which the print S is conveyed, and is on the upstream side of the first film positioning roller 34. The leading edge sensors 6*a* and 6*b* can detect the leading edge of the print S while the print S is being conveyed. In terms of the direction roughly perpendicular to the direction in which the print S is conveyed, the leading edge sensor 6*a* is on one side of the passage of the print S, and the leading edge sensor 6*b* is on the other side.

Further, the surface processing apparatus 100 has an image sensor 60 of the contact type (which hereafter may be referred to simply as CIS) as a means for reading the image on the print S (medium to be processed). In terms of the direction in which the print S is conveyed, the CIS is on the upstream side of the pair of conveyance rollers 4.

Figure 10:
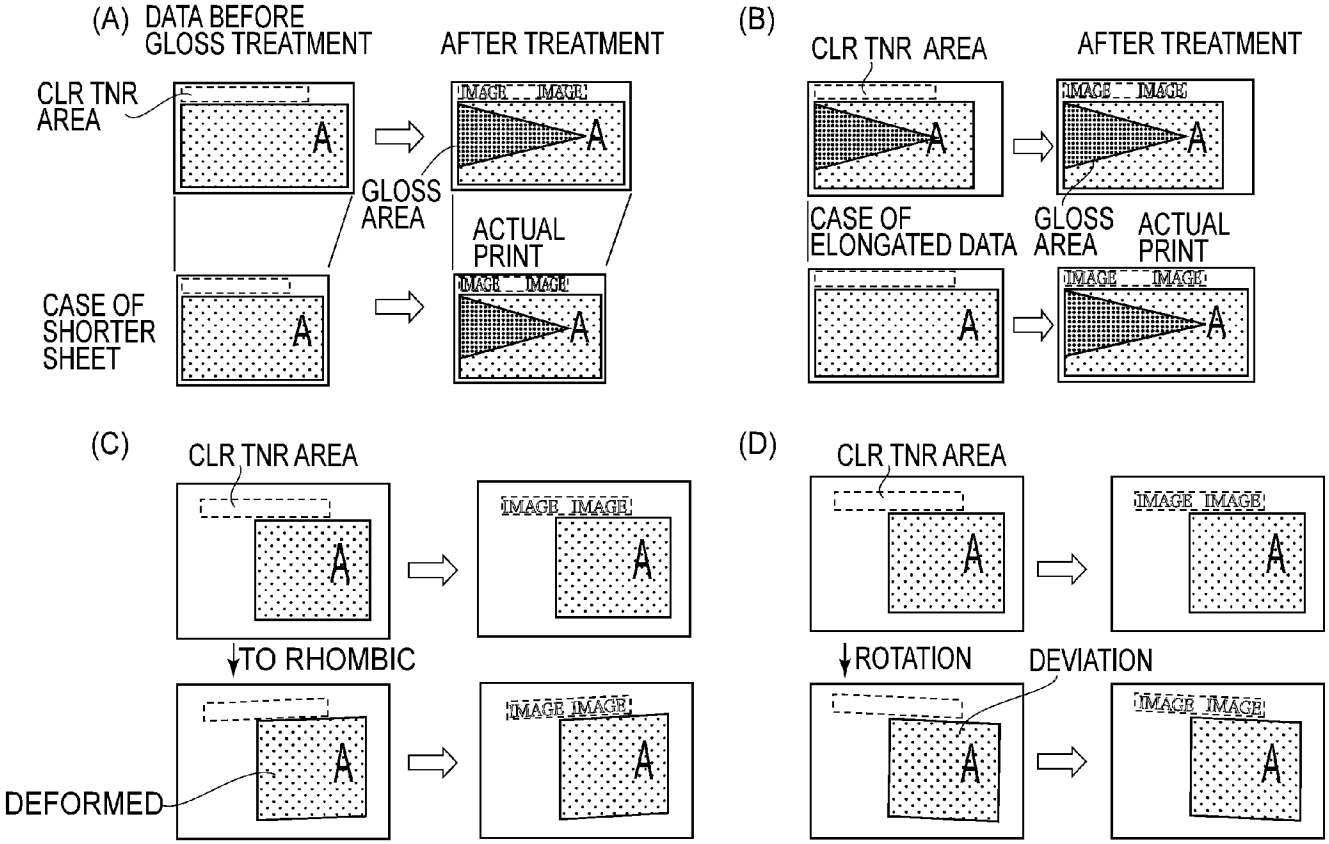
FIG. 10 is a drawing for showing the theoretical print based on the data of the image to be formed (original image), before and after its gloss alteration based on the gloss alteration pattern in the gloss alteration data, and the actual image on the print S, before and after its gloss alteration based on the new (modified) alteration data.

Further, the surface processing apparatus 100 has a pair of line sensors 61*a* and 61*b*, shown in FIG. 10, (which hereafter may be referred to as "side edge sensor") as means for detecting the position of the side edges of the print S (medium to be processed). In terms of the direction in which the print S is conveyed, the line sensor 61*a* and 61*b* are on the upstream side of both the pair of registration rollers 5 and pair of conveyance rollers 4, and detect the presence or absence of the print S (medium to be processed) (more specifically, edges of print S) which are roughly perpendicular to direction in which print S is conveyed). Referring to FIG. 9, in this embodiment, in terms of the direction which is roughly perpendicular to the direction in which the print S is conveyed, the side edge sensor 61*a* is on one side of the passage of the print S, and the side edge sensor 61*b* is on the other side.

The film 11 is stored in a film cartridge 14 so that it can be easily mounted into, or removed from, the main assembly 1 of the surface processing apparatus 100.

Further, the surface processing apparatus 100 has a pair of discharge rollers 10 for discharging the print S (medium to be processed) from the main assembly 1 of the surface processing apparatus 100 (which hereafter may be referred to simply as "apparatus main assembly 1") after the surface processing of the print S. Further, the surface processing apparatus 100 has the aforementioned external delivery tray 16, into which the prints S are placed in layers as they are discharged from the apparatus main assembly 1.

2. Structure of Each Section of Surface Processing Apparatus

Next, the structure of each of the various sections of the surface processing apparatus 100 is described.

2-1. Thermal Head

Figure 3:
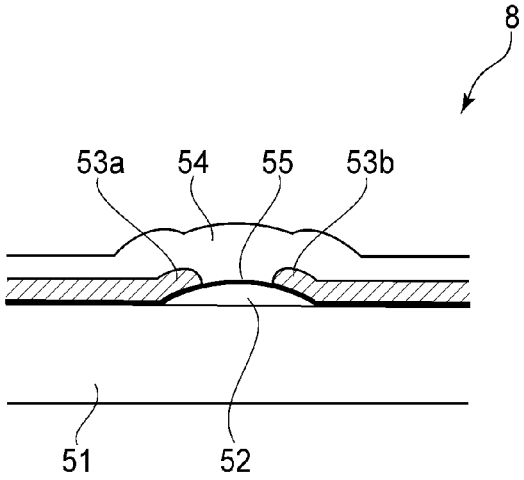
FIG. 3 is a schematic vertical sectional view of an example of the thermal head, and shows the structure of the thermal head.

First, the basic structure and specifications of the thermal head 8 are described. Referring to FIG. 3, which is a schematic sectional view of the thermal head 8, and is for illustrating the general structure of the thermal head 8, the thermal head 8 has: a substrate 51 made of alumina or the like; a glaze 52 (thermal insulation layer) formed on the substrate 51 by printing; common electrode 53*a* formed on the substrate 51; lead electrodes 53*b* formed on the substrate 51; heat generating resistors 55 formed in connection to the electrodes 53*a* and 53*b*, on the glaze 52; and a protective film 54 (overcoat layer) which covers the abovementioned substrate 51, thermal insulation layer 52, electrodes 53*a* and 53*b*, and heat generating resistors 55. The thermal head 8 is connected to a driver circuit 160 (FIG. 6) for supplying the selected heat generating resistors with electric power to make them generate heat. The thermal head 8 is also provided with heat radiation plates or the like to radiate away the heat remaining after heating the print S (medium to be processed). More specifically, the thermal head 8 has multiple heat generating resistors (heating elements) aligned in the direction that is roughly perpendicular to the direction in which the print S is conveyed. Thus, it can selectively heat various sections (selected sections) of the print S in terms of the direction in which the heat generating resistors are aligned, through the film 11.

The thermal head 8 in this embodiment is 300 dpi in heat generating resistor density, 300 dpi in recording density (process density), 30 V in driving voltage, and 5,000Ω in the average electrical resistance value of the heat resistance resistors. However, this embodiment is not intended to limit the present invention in terms of the structure and specifications of the thermal head 8.

Figure 2:
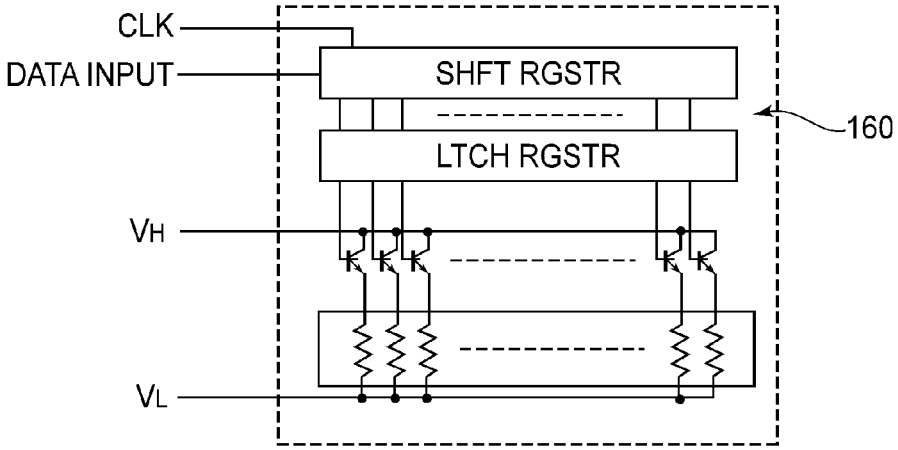
FIG. 2 is a diagram of an example of a circuit for driving a thermal head.

FIG. 2 is a diagram of the driver circuit of the thermal head 8. The thermal head 8 has multiple heat generating resistors aligned on the substrate 51 in the direction parallel to the direction in which the print S (medium to be processed) is conveyed. Further, it has two groups of electrodes, one group of which is on one side of the line of heat generation resistors, and the other group of which is on the other side. It has also a driver IC which includes a group of registers capable of retaining and/or transferring the data equivalent to a single line of the gloss alteration pattern. The driver IC may be on the substrate of the thermal head 8, or a substrate other than the thermal head substrate.

2-2. Platen Roller

The platen roller 7 is an elastic roller, which is made up of a shaft 7*a* (metallic core) and an elastic layer 7*b*. The elastic layer 7*b* is formed of a substance, such as a hard rubber, which is higher in coefficient of friction, around the shaft 7*a*. More specifically, the platen roller 7 in this embodiment is a heat resistant rubber roller made by forming the elastic layer 7*b* of silicone rubber, in a manner to cover the entirety of the peripheral surface of the shaft 7*a*. The platen roller 7 is rotatably attached to the apparatus main assembly 1 by the shaft 7*a*. As the shaft 7*a* is rotationally driven by a platen roller driving motor M3 (FIG. 6) as a mechanical power source for driving the platen roller 7, the print S (medium to be processed) and film 11 are conveyed. In this embodiment, the speed at which the print S is conveyed is determined by the peripheral velocity of the platen roller 7, and the data to be sent to the thermal head 8 is created in synchronism with the peripheral velocity of the platen roller 7. Also in this embodiment, during the surface processing of the print S (medium to be processed), the print S and film 11 are conveyed through the processing station T in the same direction at roughly the same speed.

2-3. Film

The film 11 (transfer film) is in the form of a roll of film with a preset length, fitted around the supply shaft 12, and is stored in the film cartridge 14. It is supplied to the processing station T by being taken up by the take-up roller 13 as necessary. The film 11 is for selectively heating various sections of the surface of the print S (medium to be processed). Therefore, it is desired to be formed of thin and flexible material.

From this stand point, it is desired to be no more than 40 μm in thickness. It may be as thin as 2 μm. From the standpoint of strength, however, it is desired to be no less than 4 μm in thickness. Further, in order for the film 11 to give the print S excellent surface properties such as those of a photograph through the surface processing of the print S, the film 11 is desired to be provided with a certain amount of rigidity. From this standpoint, the film 11 is desired to be made of one of the following substances, and is no less than 8 μm in thickness. Regarding the material for the film 11, the film 11 needs to be resistant to the heat generated by the thermal head 8. Therefore, a substance, such as polyimide, which can withstand no less than 200° C., is desired to be the material for the film 11. However, inexpensive and readily available resin film made of PET (polyethylene-terephthalate) or the like may be used as the material for the film 11. The surface (which comes into contact with print S (medium to be processed) of the film 11 may be coated with a parting layer. This functional layer is the surface layer which is low in surface energy, and is for making it easier for the film 11 to separate from the resin-based surface layer of the print S (medium to be processed). From the standpoint of precisely transferring the surface texture of the film 11 onto the surface of the print S, the film 11 is desired to smoothly and easily separate from the surface of the print S. As the material for the parting layer, fluorinated resin, silicone resin, or the like may be used. The method for forming the parting layer may be coating. However, the method does not need to be limited to coating. What is important here is that the material for the parting layer of the film 11 is such a substance that the texture which is desired to be transferred onto the print S (medium to be processed) can be easily created on the surface of the parting layer. For example, in order to make the surface layer of the print S as smooth as that of a photographic print, the substrate of the film 11 may be made smooth by coating. However, the method for creating the film 11, the surface of which is as flat and smooth as those of a photographic print, may be coating the substrate layer with one of the aforementioned resinous substances. Further, the back side (which slides on thermal head 8) of the film 11 may be provided with a stick prevention layer, in order to reduce the mechanical friction between the thermal head 8 and film 11. The stick prevention layer is required to be close in characteristics to the above-described parting layer. Concretely, it is effective to coat the back side of the film 11 with fluorinated resin, silicone resin, or the like, that is, the same type of resin as the material for the parting layer. In this embodiment, the film 11 is made of the substrate layer formed of PET, the parting layer formed on the surface of the substrate layer, and the stick prevention layer formed on the back surface of the substrate layer.

The surface processing apparatus 100 transfers the surface texture of the film 11 onto the surface of the print S (medium to be processed). Therefore, using highly glossy and flat film as the material for the film 11 makes it possible to give the surface of the print S a highly glossy photographic texture. On the other hand, using matte film created by sandblasting or the like method, or film, the surface of which is given a specific pattern, as the material for the film 11 makes it possible to give the surface of the print S the matted appearance, or reversal pattern of the specific pattern. For example, using film having such texture as the texture of silk, Japanese paper, embossed paper, or the like makes it possible to transfer the texture of one of these materials onto the surface of the print S. Obviously, it is possible to give the surface of the print S a geometrical pattern, a lattice-like pattern, or the like. That is, it is possible to give the surface of the print S various textures, that is, various textures and patterns, by using various films different in surface texture and pattern as the material for the film 11. Further, using film having geometrical patterns, the size of which is on an order of sub-micron meter to 1 μm, as the material for the film 11, makes it possible to give the surface of the print S a holographic appearance. In this embodiment, the film 11 is supplied in the form of a roll stored in the film cartridge 14, being therefore replaceable. Further, in this embodiment, the surface processing apparatus 100 can selectively process various sections of the print S. Therefore, it can selectively give the various sections of the surface of the print S various pattern and/or various colors (including holographic appearance), as necessary.

In this embodiment, the film 11 is 320 mm-350 mm in its dimension in terms of the direction roughly perpendicular to the direction in which the film 11 is moved, and so is the thermal head 8. Thus, the surface processing apparatus 100 can deal with the various prints S (mediums to be processed), which are different in size and are as large as size A3. Also in this embodiment, the film 11 is flat and smooth, and is intended for making the print S glossy. The film 11 is made of thermoplastic resin film, and is very thin. Thus, as a given section of the film 11 is used for processing the print S, this section of the film 11 is wrinkled by the heat applied by the thermal head 8, making it impossible for this section of the film 11 to be reused.

2-4. Separation Station

Next, the separation station, or the portion of the surface processing apparatus 100, at which the film 11 is separated from the print S (medium to be processed), is described. From the standpoint of properly processing the print S, the thermal head 8, and the structure of the separation station are essential. In this embodiment, the separating member 15 is required to play two roles, that is, the role of cooling the film 11, and the role of separating the print S from the film 11 by utilizing the curvature of the portion of the film 11, which is in contact with the separating member 15, by which the film 11 is changed in the direction. In this embodiment, the separating member 15 is a piece of metallic plate made of stainless steel or the like. Further, it is shaped so that its bottom corners which are in contact with the film 11 are small enough in curvature (1 mm in radius of curvature) to ensure that the print S (medium to be processed) is separated from the film 11.

Further, the separating member 15 is desired to be equipped with a cooling system (unshown) for preventing the separation station from excessively increasing in temperature. As for the type of the cooling system, it may be a cooling system which uses air flow, or the separating member 15 may be provided with simple fins.

Further, the temperature of the separation station is checked by multiple thermistors, as temperature detecting means, attached to various points of the separating member 15 in terms of the lengthwise direction of the separating member 15. The amount of airflow generated by the cooling system and/or the printing operation speed is controlled so that the temperature of the separating member 15 is kept no higher than a target temperature of T1° C. for the separating member 15. The target temperature T1° C. is desired to be set in consideration of the Tg of coloring agent, and the Tg of the resinous layers, such as the overcoat layer, of the print S (medium to be processed). In consideration of the margin between the Tg and the melting point of the surface layer of the print S, the target temperature for the separating member 15 is desired to be set to be no higher than Tg+15° C., preferably, no higher than Tg. Further, the surface layer of some prints S (medium to be processed) contain wax or the like ingredient, in addition to resin and coloring agent. In the case where such print S is to be processed, the target temperature for the separating member 15 is desired to be set to be no higher than the melting point of wax. In a case where it is impossible to determine the material of the toner, ink, or the like, the target temperature for the separating member 15 is desired to be set to be low enough, for example, as low as room temperature. More concretely, it is desired to be set to a level in a range of 30-50° C.

2-5. Medium to be Processed (Print Whose Recording Medium is Cut Paper)

In this embodiment, prints S outputted by an electrophotographic image forming apparatus were used as the media to be processed by the surface processing apparatus 100. For example, prints S are created by forming an image on a sheet of recording medium (paper) through an image formation process, which uses four coloring agents of primary colors (C, M, Y and K), and prints are created by forming an image on a sheet of a recording medium (paper) through an image formation process, which uses four coloring agents of primary colors (C, M, Y and K) and transparent toner (clear toner), that is, toner which is primarily made of resin and does not contain a coloring agent. An example of the transparent toner is a toner which is primarily made of polyester resin and does not contains pigment. Further, a toner made up of minute particles, which are made of resin, are highly transparent, contain virtually no coloring agent, being therefore virtually colorless, and pass at least visible light without dispersing the light in practical terms, can be preferably used. However, "transparent toner" does not need to be transparent and colorless until it is fixed. That is, all that is required of "transparent toner" is that it becomes transparent and colorless as it is fixed. In other words, it may appear white until it is fixed. For example, the pattern in which an image is formed of transparent toner may be created so that in order to cover the entirety of a sheet of the recording medium (paper) with toner, the sections of the sheet of the recording medium (paper), which are not covered with C, M, Y and K toners, or have a low print ratio, are covered with transparent toner. Forming an image of transparent toner in the above described pattern makes it possible to process any point or section of the print S (medium to be processed). Further, a transparent toner image may be formed so that the entire surface of the image formation area of a sheet of the recording medium (paper) is covered with a preset amount of transparent toner per unit area. For example, an electrophotographic image forming apparatus can be adjusted in the state of toner fixation so that it outputs a print which is roughly 10% in 60° gloss.

Further, the print S (medium to be processed) processed by the surface processing apparatus 100 in this embodiment does not need to be limited to a print created by the above-mentioned image formation process, which uses four, or five toners, different in color. For example, it may be a print created by forming an image on a sheet of resin-coated recording medium (paper) using an image forming process that uses four toners different in color.

Further, the print S (medium to be processed) processed by the surface processing apparatus 100 in this embodiment may be a print created by a thermal transfer recording method, a sublimation transfer recording method, an inkjet recording method, or the like. In the case where a print created with the use of one of the abovementioned methods, the entirety of the image bearing surface of a sheet of recording medium (paper) is to be covered with thermoplastic resin so that any point or section of the surface of the print S (medium to be processed) can be thermally processed.

2-6. Conveyance Roller

In this embodiment, it is assumed that the size of the smallest print S (medium to be processed) processable by the surface processing apparatus 100 is equal to the size of a photograph of size L. Thus, the surface processing apparatus 100 is structured so that the distance between the adjacent two pairs of conveyance rollers is no more than 100 mm, and also, so that the distance between platen roller 7 and immediately upstream pair of conveyance rollers, and the distance between the platen roller 7 and immediately downstream pair of conveyance rollers, also are 100 mm.

3. Surface Processing Operation

Figure 6:
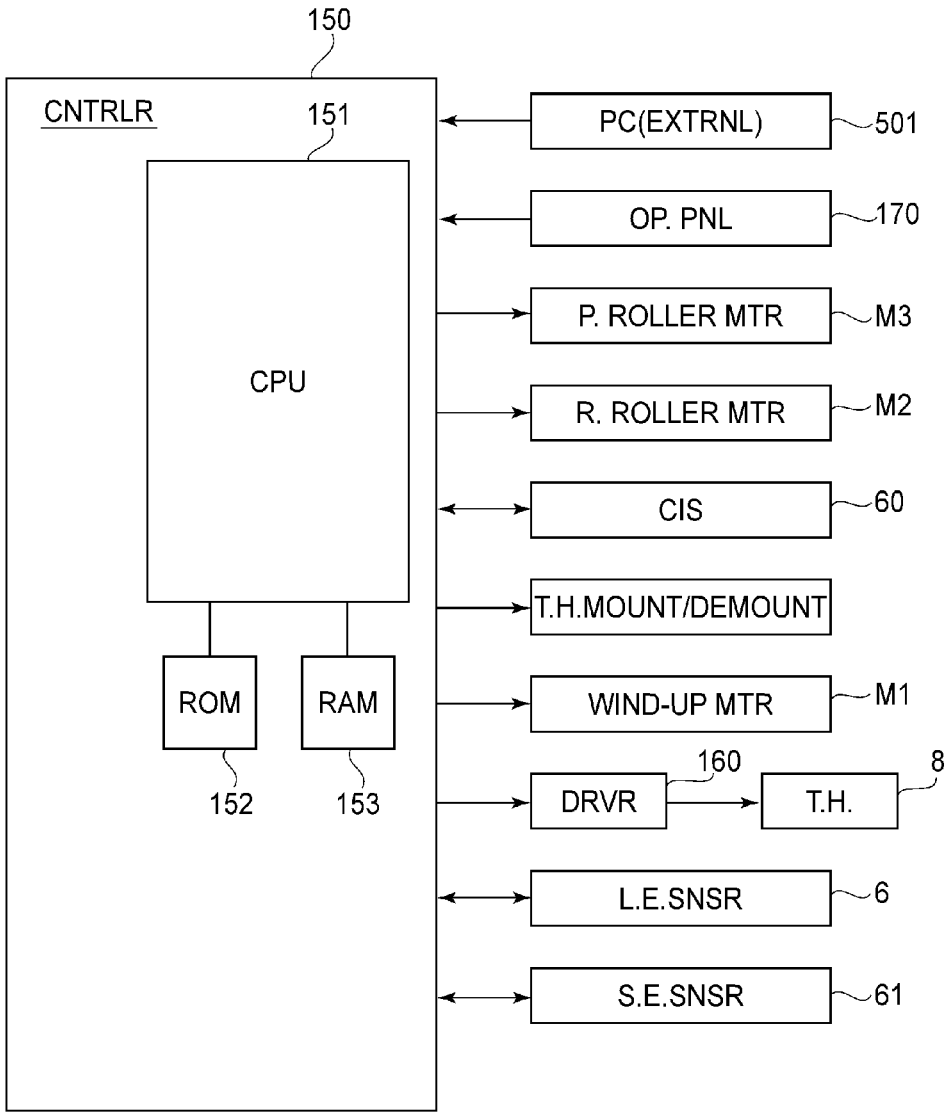
FIG. 6 is a block diagram of the surface processing apparatus in the first embodiment of the present invention, and shows the control system of the surface processing apparatus.

FIG. 6 is a block diagram of the control system of the surface processing apparatus in the first embodiment of the present invention.

The operation of the surface processing apparatus 100 is controlled by a controller 150 as a controlling means. To the controller 150, gloss alteration process data (process start command, gloss alteration command, heating process start command) are transmitted from an external apparatus 501, such as a personal computer, and/or control panel 170. A CPU 151 as a computation controlling means receives the gloss alternation process data. Further, the CPU 151 controls the conveyance of the print S (medium to be processed) by the pair of conveyance rollers 4, the pair of conveyance rollers 9, the pair of registration rollers 5, and the like conveying means. It controls also the reading operation of the image sensor 60 (CIS), the operation for placing the thermal head 8 against the surface of the print S (medium to be processed) through film 11 or moving the thermal head 8 away from the print S, and the like operation. Further, it controls the operation of the take-up shaft 13 as film winding means, the operation for driving the driver circuit 160 of the thermal head 8, the operation of the leading edge sensor 6 as the means for detecting the print S, the operation of the side edge detection sensors 61 as the means for detecting the print S, and the like operation.

To describe further, the various operations of the surface processing apparatus 100 are integrally controlled by the controller 150 (control section). The controller 150 controls each of the various sections of the surface processing apparatus 100, based on the gloss alteration data sent from an external apparatus 501 such as a personal computer, and the gloss alteration data inputted through the control panel 170 of the surface processing apparatus 100. The controller 150 has the CPU 151, ROMs 152 as storage means, and RAMs 153 as storage means, and controls the operations of the various sections of the surface processing apparatus 100, based on the gloss alteration data, following the programs and data stored in the ROMs 152 and RAMs 153. The gloss alteration data includes the gloss alteration pattern (information about position of sections to be heated, of print S (medium to be processed) in which the selected sections of the surface of the print S are heated by the thermal head 8 with the same timing as that with which the selected sections are moved through the processing station T. Further, the gloss alteration data include the data of the original image (information about image to be formed), which is the information, based on which an image is formed on a sheet of recording medium. Incidentally, the data of the original image includes the information about the position of the image on the print S (sheet of recording medium), relative to the sheet of recording medium of the print S. Further, the gloss alteration data includes the information about the size of the print S (medium to be processed), and also, the gloss alteration pattern. It may include the information which shows the sections of the image, which are to be processed.

The thermal head 8 processes the selected sections of the surface of the print S (medium to be processed) by making its heat generating resistors generate heat, based on the gloss alteration data such as the one described above, as will be described later in more detail. In this embodiment, as the gloss alteration data are inputted into the controller 150, they are stored in the RAMs 153.

Figure 7:
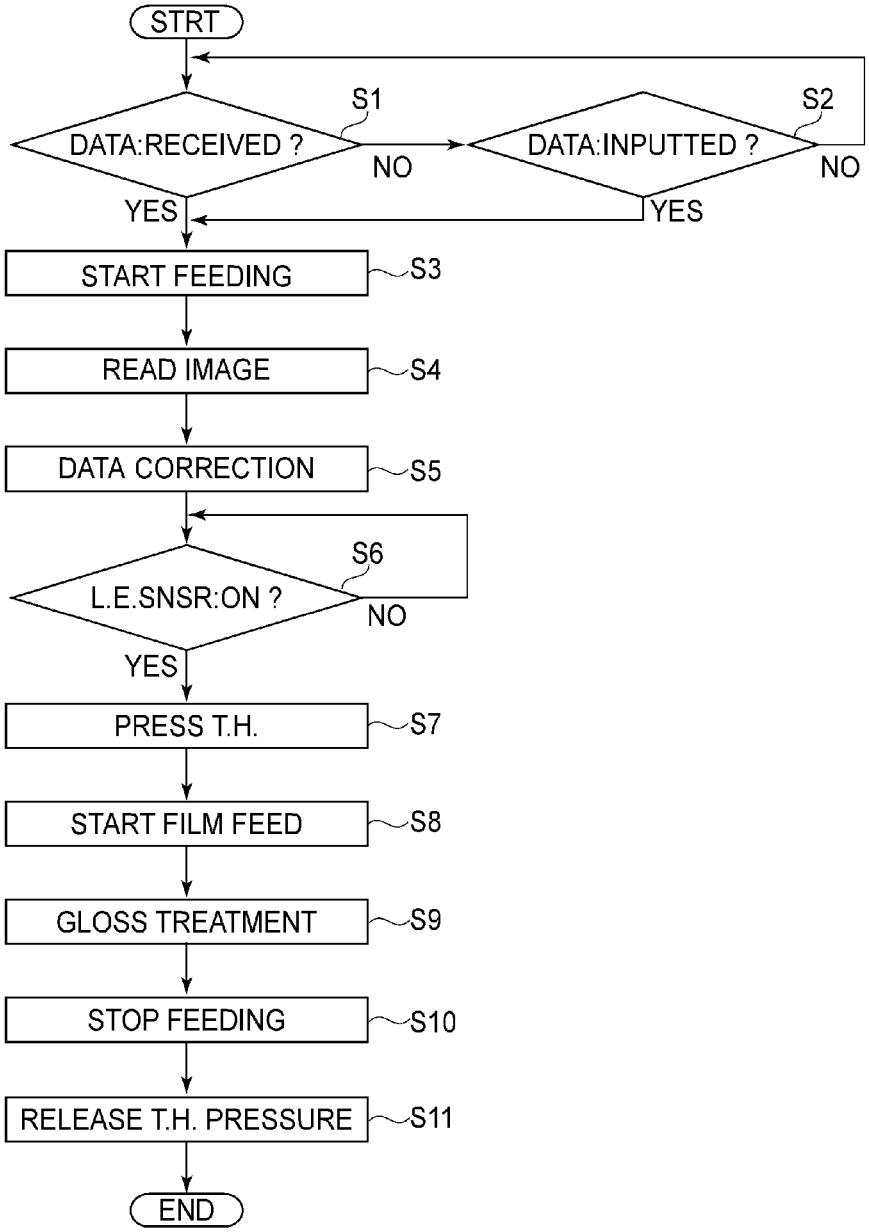
FIG. 7 is a flowchart of an example of the operational sequence of the gloss altering apparatus in accordance with the present invention.

FIG. 7 shows the operational sequence of the surface processing operation of the surface processing apparatus 100 in this embodiment.

Referring to FIG. 7, first, the controller 150 carries out the following procedures in S1 and S2. That is, the controller 150 determines whether or not the gloss alteration data have been received from the external apparatus 501 such as a personal computer and the like device (USB memory, SD card, etc.) which are connected to the surface processing apparatus 100 (S1), and/or whether or not the gloss alteration data has been inputted through the control panel 170 (S2). The gloss alteration data are made up of the size of the print S (medium to be processed), the gloss alteration pattern, the gloss alteration sections of the print S, data of the original image, and the like information.

As the gloss alteration data are received or inputted, the controller 150 begins to convey the print S (medium to be processed) in S3. That is, the prints S created by forming an image on a sheet P of the recording medium and stored in layers in the cassette 2 are fed one by one into the apparatus main assembly 1 by the feed roller 3 while being separated from the rest, and conveyed further into the apparatus main assembly 1 by the pair of conveyance rollers 4 while remaining pinched by the pair of conveyance rollers 4.

Then, in S4, the controller 150 reads the contour (profile) of the print S (medium to be processed) and the image on the print S by controlling the CIS 60. Referring to FIG. 9, the CIS 60 is positioned so that the relationship between the distance L0 between the CIS 60, and the processing station T (nip) in which the print S is processed, and the maximum length Lp of the print S (medium to be processed) in terms of the direction in which the print S is conveyed, satisfies: L0>Lp. Therefore, the controller 150 can finish the reading and image data processing, before the gloss alteration process is started.

Next, in S5, the controller 150 carries out the following procedures. That is, the controller 150 compares the data regarding the contour of the print S (medium to be processed), that is, the information about the contour of the print S, and the data of the image on the print S (information of actual image), which were read in S4, with the gloss alteration data received in S1, or inputted in S2. The gloss alteration data include the size of the print S (medium to be processed), the gloss alteration pattern, sections of the print S to be processed, data of the original image (theoretical image), etc., as described above. Thus, the controller 150 modifies the gloss alteration pattern in the gloss alteration data to compensate for the difference between the data read in S4 and those received in S1 or S2.

More concretely, the controller 150 obtains the information which shows the difference between the image position relative to the print S (medium to be processed), which is in the gloss alteration data included in the data of the original image (theoretical image), and the image position relative to the sheet of recording medium of the print S, which is indicated by the data of the contour of the print S, and the data of the image (actual image) on the print S. Then, the controller 150 modifies the gloss alteration pattern included in the gloss alteration data, based on the difference. Then, the controller 150 controls the thermal head 8, based on the modified gloss alteration pattern, during the gloss alteration process (heating process), as will be described later.

That is, in this embodiment, the controller 150 has the data of the original image and the gloss alteration pattern inputted as the gloss alteration data from the external apparatus 501. Further, to the controller 150, the contour shape data of the print S (medium to be processed) and the data of the actual image on the print S are inputted from the CIS 60. The data of the original image (theoretical image) includes the information about the position of the theoretical image relative to a sheet of the recording medium on which the image is to be formed, based on the data of the original image. Therefore, the following become possible by comparing the position of the theoretical image relative to the sheet of recording medium, with the position of the actual image on the print S relative to the recording medium of the print S. That is, it becomes possible to obtain the amount of difference between the position of the theoretical image relative to the sheet of recording medium, and the position of the actual image on the print S relative to the recording medium of the print S.

More concretely, in this embodiment, the controller 150 obtains the position of the actual image on the print S (medium to be processed) relative to the edge (leading edge) of the sheet of the recording medium of the print S in terms of the recording medium conveyance direction, from the data of the contour of the sheet of recording medium of the print S, and data of the actual image, which were inputted from the CIS 60. Then, the controller 150 compares the position of the actual image on the print S relative to the leading edge, with the position of the theoretical image relative to the leading edge, which the data of the original image (theoretical image) indicates. With this comparison, the controller 150 can obtain the ratio of enlargement or reduction in size of the actual image on the print S relative to the size of the original image (theoretical image). This method, in this embodiment, of obtaining the ratio of enlargement or reduction in size between the actual image and theoretical image is not intended to limit the present invention in terms of the method for obtaining the ratio of enlargement or reduction in size between the actual image and theoretical image. That is, the method is optional; any method available in the field of image formation may be used.

Further, the controller 150 obtains the position of the image on the print S (medium to be processed) relative to the leading edge of the sheet of the recording medium of the print S, and the position of the image on the print S relative to one of the side edges of the sheet of recording medium of the print, which are roughly parallel to the print conveyance direction, based on the data of the contour of the print S, which were inputted from the CIS, and the data of the actual image on the print S. Then, the controller 150 can obtain the amount of linear offset of the image on the print S from its theoretical position on the print S relative to the leading edge of the sheet of recording medium of the print S, the amount of rotational deviation of the image on the print S from the theoretical position, and the amount of deformation of the image on the print S relative to the theoretical shape (shape of original image), which the data of the original image indicate. The side edge of the sheet of the recording medium of the print S, which is to be used as the reference edge, may be either of the two side edges. As for the amount of linear offset of the image, it means the offset in the direction parallel and/or roughly perpendicular to, the direction indicated as the recording medium conveyance direction by the data of the original image. As for the rotational deviation, it means the angle of tilt of the sheet of the recording medium of the print S relative to the recording medium conveyance direction indicated by the data of the original image. Further, the image deformation means such deformation of an image as the deformation of a rectangle into a rhombic, that is, such deformation of an image that the position of every picture element of the image indicated by the data of the original image shifts at a preset ratio in the direction which is roughly perpendicular to the recording medium conveyance direction. This embodiment, however, is not intended to limit the present invention in terms of the method for obtaining the amount of linear offset of the image, amount of rotational deviation (angular deviation), and ratio of enlargement or reduction in size of the image, by computation. That is, the method is optional; any methods available in the field of image formation may be used.

Figure 8:
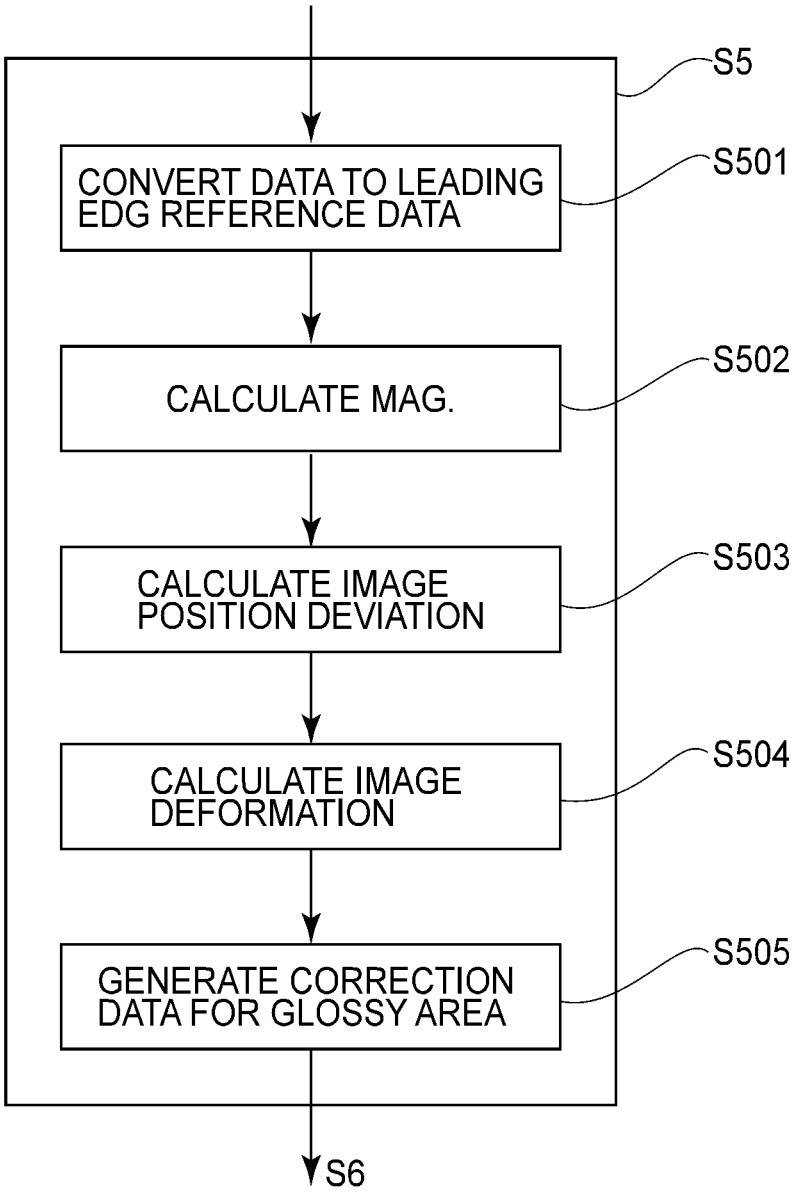
FIG. 8 is a flowchart of an example of the operational sequence for modifying the gloss alteration pattern, in accordance with the present invention.

FIG. 8 is a flowchart of an example of the operational sequence of the gloss alteration process (S5), and shows the details of the process.

In S501, the controller 150 converts the data of the actual image read in S4, into data, the reference line of which is the leading edge of the sheet of the recording medium of the print S (medium to be processed, based on the data of the contour of the sheet of the recording medium of the print S.

Then, in S502, the controller 150 performs the following operations. That is, it calculates the rate of enlargement or reduction in size of the actual image, by comparing the data of the original image in the gloss alteration data (size of sheet of recording medium of print S prior to image formation), the gloss alteration pattern, the gross alteration sections, data of original image, etc.) received in S1, or inputted in S2, with the data of the actual image which was read in S4. Typically, what is compared in S502 is the entirety of the data of the original image in the gloss alteration data received in S1 or inputted in S2. However, it may be a part of the data of the original image. In the case where a part of the data of the original image is compared, it is desired to include a minimum of the gloss alteration section (gloss alteration pattern and adjacencies of gloss alternation sections) in order to obtain the ratio of the change in size of the gloss alteration sections, at a higher level of accuracy.

Next, in S503, the controller 150 performs the following operations, as it did in S502. That is, it calculates the amount of the positional deviation (amount of linear and rotational offset of actual image on print S (medium to be processed) from its theoretical position) of the actual image on the sheet of recording medium of the print S, from its theoretical position which the data of the original image indicates, by comparing the data of the original image in the gloss alteration data, with the data of the actual image and the data of the contour of the recording medium of the print S.

Then, in S504, the controller 150 calculates the amount of the deformation of the actual image relative to the original image, by comparing the data of the original image in the gloss alteration data, with the data of the actual image and the data of the shape of the contour of the sheet of the recording medium of the print S (medium to be processed), as it did in S502 and S503. The amount of deformation of the actual image is calculated with reference to the center of the image indicated by the image data.

Next, in S505, the controller 150 creates the data for altering the gloss alteration pattern which includes and shows the points (sections) of the sheet of the recording medium of the print S (medium to be processed), which are to be heated, based on the rate of enlargement or reduction in size, the amount of deformation, and the amount of positional deviation, which are obtained in S501-S504. Then, it advances to S6 shown in FIG. 7. Incidentally, the operations in S502-S504 may be carried out in parallel.

As described above, in this embodiment, (1) in a case where the actual image is different in size from the theoretical image in the data of the original image, (2) in a case where the actual image is linearly offset in position from the theoretical image, (3) in a case where the actual image is rotationally deviated in position from the theoretical image, and (4) in a case where the actual image is different in shape from the theoretical image, the gloss alteration pattern in the gloss alteration data is altered as follows. That is, in the case (1) where the actual image is different in size from the theoretical image in the data of the original image, the controller 150 creates a new gloss alteration pattern by altering in size the gloss alternation pattern in the gloss alteration data, based on the rate of change in size calculated in S502. In the case (2) where the actual image is linearly offset in position from the theoretical image, the controller 150 changes the position of the gloss alteration pattern relative to the leading edge of the print S (medium to be processed in terms of the recording medium conveyance direction, and/or one of the side edges of the print S. In the case (3) where the actual image is rotationally deviated in position from the theoretical image, the controller 150 rotates the gloss alteration pattern about the image center (in terms of recording medium conveyance direction). In the case (4) where the actual image is different in shape from the theoretical image, the controller 150 creates a new gloss alteration pattern by altering the gloss alteration pattern in the gloss alteration data, according to the amount of deformation (in terms of both vertical and horizontal direction) of the actual image relative to the theoretical image, with reference to the center of the theoretical image in the image data. Typically, the image deformation means that every picture element of the image in accordance with the data of the original image shifts in the direction roughly perpendicular to the recording medium conveyance direction, at a preset ratio. Therefore, the new gloss alteration pattern also can be created by shifting every picture element of the original image in the direction roughly perpendicular to the recording medium conveyance direction at a preset ratio.

Incidentally, it is not true that the actual image on the sheet of the recording medium of the print S (opp) is always different from the theoretical image in accordance with the data of the original image, in terms of the linear offset, the rotational deviation, the deformation, and the change in size. For example, sometimes, only one of the differences occurs because of the characteristic of the image forming apparatus which forms an image on the print S (opp). In this embodiment, therefore, the surface processing apparatus 100 is enabled to deal with any difference between the actual image and the theoretical image, no matter which the difference is, i.e., the offset, the rotation, the deformation, or the change in size, as described above. However, the surface processing apparatus 100 may be enabled to deal with only one of the differences, or a combination of two or more of the differences.

Referring again to FIG. 7, in this embodiment, the controller 150 conveys the print S (medium to be processed) to the position of the pair of registration rollers 5, at the same time as it performs the operation in S4. Then, it makes the pair of registration rollers 5 temporarily stop the print S to correct the print S in attitude. There are the side edge sensors 61 (61*a* and 61*b*) on the upstream side of the pair of registration rollers 5. Therefore, the controller 150 detects the position of both side edges of the print S, by controlling the side edge sensors 61, while it is temporarily holding the print S by the pair of registration rollers 5. After the detection of the position of the side edges, the controller 150 starts conveying again the print S, by driving the pair of registration rollers 5. In this embodiment, the operation in S5 is carried out after the restarting of the conveyance of the print S, and the print S is read from its leading edge to its trailing edge.

Then, in S6, the controller 150 detects the leading edge of the print S (medium to be processed) by the leading edge sensors 6 (6*a* and 6*b*). Then, the controller 150 decides the point (in terms of both the recording medium conveyance direction and the direction roughly perpendicular to recording medium conveyance direction) of the surface of the print S at which the gloss alteration process is to be started, based on the following information: the position of the side edges detected by the side edge sensors 61 (61*a* and 61*b*); the shape of the contour of the print S, which was read in S4; the position of the leading edge of the print S detected by the leading edge sensor 6 (6*a* and 6*b*); and the new gloss alteration pattern created in S5 by modifying the gloss alteration pattern in the gloss alteration data.

Figure 4:
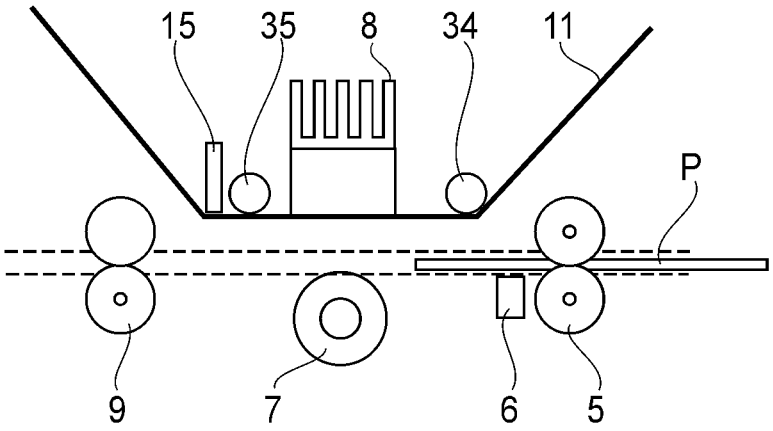
FIG. 4 is a schematic drawing for illustrating the operation for pressing the thermal head against the surface of the print to be processed, and the operation for moving the thermal head away from the surface of the print to be processed.

Next, referring to FIG. 4, in this embodiment, when the thermal head 8 is not in operation, it is kept on standby in its position which is away from the platen roller 7. In S7, the controller 150 performs the following operation, that is, referring to FIG. 5, based on the timing with which the leading edge of the print S (medium to be processed) passes by the leading edge sensors 6 (6*a* and 6*b*): the controller 150 controls the operation (pressing movement) of the thermal head driving means so that the thermal head 8 is moved in the downward direction of the drawing, and presses the platen roller 7. In this embodiment, the thermal head moving means is provided with a pressure applying means, such as springs, for pressing the thermal head holder which holds the thermal head 8, toward the platen roller 7. Further, the thermal head moving means has a thermal head holder moving means, such as a cam or the like, for moving the thermal holder away from the platen roller 7. It has also a mechanical power source, such as a motor, for driving the thermal head holder moving means. Thus, the controller 150 can control the operation for making the thermal head 8 press on the platen roller 7 or move the thermal head 8 away from the platen roller 7, and the timing for the operations, by controlling the mechanical power source for the thermal head moving means. In this embodiment, the surface processing apparatus 100 is structured so that the thermal head 8 is made to press, or move away from, the platen roller 7. This structural arrangement is desirable from the standpoint of the reduction of the amount of film 11 consumed. However, the surface processing apparatus 100 may be structured so that the thermal head 8 is kept always pressed against the platen roller 7.

Figure 5:
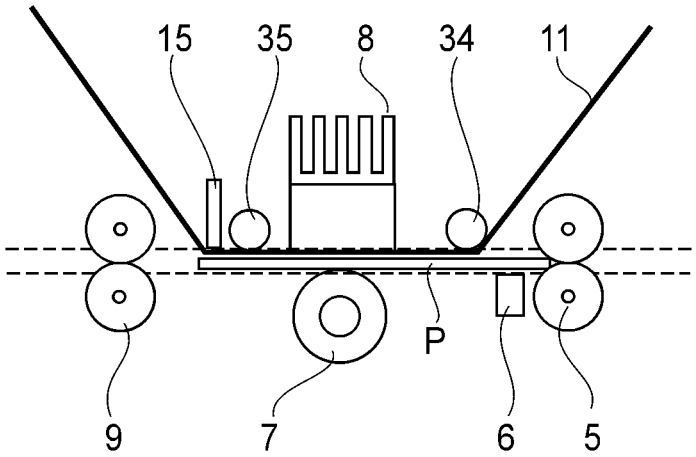
FIG. 5 also is a schematic drawing for illustrating the operation for pressing the thermal head against the surface of the print to be processed, and the operation for moving the thermal head away from the surface of the print to be processed.

The controller 150 begins to convey the film 11 in step S8 after the thermal head 8 is pressed against the platen roller 7 in S7. That is, when the surface processing apparatus 100 is in the state shown in FIG. 4, the take-up shaft 13 is remaining stationary. Then, as the thermal head 8 is pressed against the platen roller 7 as shown in FIG. 5, the controller 150 begins to drive the take-up shaft 13. In other words, the take-up shaft 13 is made to play not only the role of taking up (winding) the film 11 as the print S (medium to be processed) is conveyed, but also, the role of providing the film 11 with the tension for making the film 11 separate from the print S, during the gloss alteration operation.

In the gloss alteration station T (nip), the platen roller 7 and the thermal head 8 (heat generating resistors of which can be selectively made to generate heat according to the gloss alteration pattern) oppose each other with the presence of the passage through which the print S (medium to be processed) is conveyed, between the platen roller 7 and thermal head 8. During the gloss alteration operation, the film 11 is conveyed along with the print S through the gloss alteration station T, with the film 11 being under the thermal head 8, and the print S being under the film 11. The film 11, which is in the cassette 14, is pulled out of the cassette 14 by the friction between the platen roller 7 and print S (medium to be processed), and is conveyed, along with the print S, through the gloss alteration station T, that is, the nip between the thermal head 8 and platen roller 7, by the friction between the platen roller 7 and print S.

In S9, the controller 150 controls the thermal head 8 so that the heat generating resistors of the thermal head 8 are selectively made to generate heat, based on the new gloss alteration pattern obtained by modifying the gloss alteration pattern in the gloss alteration data in S5. Thus, as the film 11 and print S (medium to be processed) are conveyed between the thermal head 8 and platen roller 7 while remaining pinched by the thermal head 8 and platen roller 7, the toner image on the print S is melted so that it solidifies in the new gloss alteration pattern. There is the separating member 15 on the downstream side of the thermal head 8 in terms of the direction in which the print S is to be conveyed. Thus, the film 11 is separated from the print S at the location of the separating member 15. By the time the film 11 is separated from the print S by the separating member 15, the print S is sufficiently cooled. Therefore, the solidified toner image on the surface of the print S retains the surface texture transferred onto the surface of the print S from the film 11, that is, the desired amount of gloss transferred from the film 11.

The take-up shaft 13, which is in the film cartridge 14, is connected to the driving device (take-up shaft driving motor M1). Further, the supply shaft 12 may be provided with a driving device so that the film 11 can be wound in the opposite direction from the normal direction to prevent the film 11 from slacking. Not only does the take-up shaft 13 take up the film 11 as the print S (medium to be processed) is conveyed, but also, it provides the film 11 with a proper amount of tension for making the film 11 separate from the print S (medium to be processed) at the position of the separating member 15. This tension is generated by setting a slightly faster the speed with which the film 11 is taken up, than the speed with which the print S is conveyed, and providing the driving device with a torque limiter or the like.

After the completion of the gloss alteration process, the controller 150 stops the rotation of the take-up shaft 13 in S10, and then, moves the thermal head 8 away from the platen roller 7 (stops pressing film 11 and print S against platen roller 7) in S11, as shown in FIG. 4.

Lastly, the print S (medium to be processed) is guided to the pair of discharge rollers 10, and is discharged from the apparatus main assembly 1, ending the gloss alteration process. In this embodiment, the speed with which the print S (medium to be processed) is conveyed during the surface processing operation (recording period) is kept at 100 mm/sec.

FIG. 10 shows the theoretical print to be formed based on the data of the original image, before and after its gloss alteration to be carried out based on the gloss alteration data in the gloss alteration data, and the actual image on the print S (medium to be processed), before and after its gloss alteration carried out based on the new (modified) alteration data.

FIG. 10(A) represents the case in which the print S (medium to be processed) is shorter than the theoretical print in terms of the print conveyance direction. In this case, a set of characters spelling "IMAGE IMAGE" is created in reduced measurement in terms of the print conveyance direction, across one of the transparent sections of the image on the sheet of the recording medium of the print S, in such a manner that the relationship between the theoretical image, and the actual image on the print S (medium to be processed) is shown in terms of the positional relationship between the apex of the triangular gloss alteration section and a character A.

FIG. 10(B) represents the case in which the actual image on print S (medium to be processed) is greater in the measurement in terms of the print conveyance direction than the theoretical one. In this case, a set of glossy letters spelling "IMAGE IMAGE", which extends in the print conveyance direction, are formed across the section of the sheet of the recording medium of the print S, which is covered with the transparent toner, and is greater in dimension in terms of the print conveyance direction than the counterpart of the theoretical print, and also that the relationship between the theoretical image and actual image on the print S in terms of the positional relationship between the apex of the triangular gloss alteration section and the character A matches that of the theoretical print.

FIG. 10(C) represents the case in which the actual image on the print S (medium to be processed) is rhombic whereas the theoretical image is rectangular. In this case, the data for forming the glossy characters spelling "IMAGE IMAGE" are modified so that as they are formed across the rhombic section of the recording medium of the print S, which is covered the transparent toner, they are deformed in the rhombic fashion.

FIG. 10(D) represents the case in which the actual image on the print S (medium to be processed) is rotationally deviated in position from the theoretical image. In this case, the data for forming the glossy characters spelling "IMAGE IMAGE" across the section of the actual image, which is covered with the transparent toner, are modified so that the glossy characters are formed as if they are rotated with the section of the image covered with the transparent image.

As described above, the surface processing apparatus 100 in this embodiment has the pair of conveyance rollers 4, the pair of conveyance rollers 9, pair of registration rollers 5, the platen roller 7, etc., which function as the means for conveying the print S (medium to be processed). Further, it has the thermal head 8, as heating means, which is capable of selectively heating, through the film 11, various sections of the surface of the print S, in terms of the direction roughly perpendicular to the print conveyance direction. This surface processing apparatus 100 selectively heats, with the use of its heating means, various sections of the surface of the print S, across which the image formed based on the information of the original image is present, while the print S is conveyed by the conveying means 7.

Further, the surface processing apparatus 100 in this embodiment has the controller 150, as a controlling means, which controls the heating operation carried out by the heating means 8. It has also the information inputting means for inputting the information of the original image into the controlling means 150. In this embodiment, the interface through which information is inputted into the controlling means 150 from the external apparatus 501, and/or the control panel 17, functions as the image data inputting means. Further, the surface processing apparatus 100 has the following reading means. That is, in terms of the direction in which the print S (medium to be processed) is conveyed, the reading means is positioned on the upstream side of the heating station T in which the print S is heated by the heating means 8. It reads the shape of the contour of the print S whose surface has the image formed based on the information of the original image, and the image on the print S. Further, the reading means inputs into the controller 150, the information about the shape of the contour of the print S, and the information about the image on the print S. In this embodiment, the CIS 60 is the reading means. Further, the surface processing apparatus 100 has a means for inputting into the controller 150, the information about the sections of the surface of the print S, which are to be heated by the heating means 8. In this embodiment, the interface through which information is inputted into the controller 150 from the external apparatus 510, and the control panel 17, are the means for inputting the information about the sections of the surface of the print S, which are to be heated.

Further, the controller 150 in this embodiment obtains the difference between the position of the theoretical image relative to a sheet of recording medium on which the theoretical image is to be formed, which is indicated by the information about the original image, and the position of the image (actual image) on the print S (medium to be processed) relative to the sheet of recording medium of the print S, which is indicated by the information about the shape of the contour of the image (actual image) on the print S, and the information about the image (actual image) on the sheet S. Then, the controller 150 modifies the inputted information about the sections of the print S (medium to be processed) to be heated, based on the difference, and controls the heating means 8, based on the modified information about the sections of the print S to be heated. In particular, in this embodiment, the controller 150 obtains information which shows at least one among the amount of offset, rotation, deformation, and the ratio of increase or reduction in size of the image (actual image) on the print S, relative to the image (theoretical image) based on the data of the original image. To describe in more detail, the controller 150 performs the following operations, in order to modify the gloss alteration pattern so that a compensation is made for at least one among the aforementioned amount of offset, the amount of deformation, the amount of rotation, and the amount of change in the ratio of increase or reduction in size of the image on the print S relative to the theoretical image. That is, it modifies the information about the sections of the print S (medium to be processed), which are to be heated by the heating means 8; it offsets, rotates, deforms, and/or changes in size, the heating pattern which the inputted information about the sections of the print S, which are to be heated.

Further, in this embodiment, the surface processing apparatus 100 has the side edge sensor 61, which is positioned on the upstream side of the heating station T in terms of the direction in which the print S (medium to be processed) is conveyed, and is the means for detecting the position of the edges of the print S, which are roughly perpendicular to the direction in which the print S is conveyed. Further, the surface processing apparatus 100 has the leading edge sensor 6, which is positioned on the upstream side of the heating station T in terms of the direction in which the print S is conveyed, and is the means for detecting the leading edge of the print S in terms of the direction in which the print S is conveyed. The controller 150 decides the point of the sheet of the recording medium of the print S, at which the heating is to be started, by the heating means 8, based on the position of the leading edge of the print S detected by the leading edge sensor 6, and the modified information about the position of the selected sections of the print S.

Further, in this embodiment, the reading means 60 reads the shape of the contour of the print S (medium to be processed) and the image on the print S before the heating of the print S by the heating means 8 is started. In particular, in this embodiment, the distance between the point at which the image on the print S is read by the reading means 60 and the position of the heating mean 8 is greater than the dimension of the longest print S in terms of the direction in which the print S is conveyed.

As is evident from the description of this embodiment given above, when the selected sections of the image on the print S (medium to be processed) need to be altered in surface properties, the present invention makes it possible to precisely align the gloss alteration pattern with the image on the print S, even in the following situation: even if the image on the print S (medium to be processed) is linearly and/or rotationally offset relative to the image (theoretical image) based on the inputted data of the original image, and/or the recording medium of the print S has shrunk. Thus, when the selected sections of the image on the print S need to be altered in surface properties, the present invention makes it possible to process the correct sections of the print S (medium to be processed).

Embodiment 2

Next, another embodiment of the present invention is described. The components of the surface processing apparatus in this embodiment, which are the same in structure and/or function as the counterparts in the first embodiment, or equivalent in structure and/or function as the counterparts in the first embodiment, are given the same reference codes as the counterparts, and are not going to be described in detail.

In the first embodiment, the surface processing apparatus 100 was independent from the image forming apparatus. That is, the print to be processed by the surface processing apparatus 100 was produced by the electrophotographic image forming apparatus which was independent from the surface processing apparatus 100. However, the present invention is also applicable to a surface processing apparatus which is permanently connected to an electrophotographic image forming apparatus, and into which a print (medium to be processed) is conveyed as soon as an image is formed on the recording medium for the print by the image forming apparatus.

Figure 11:
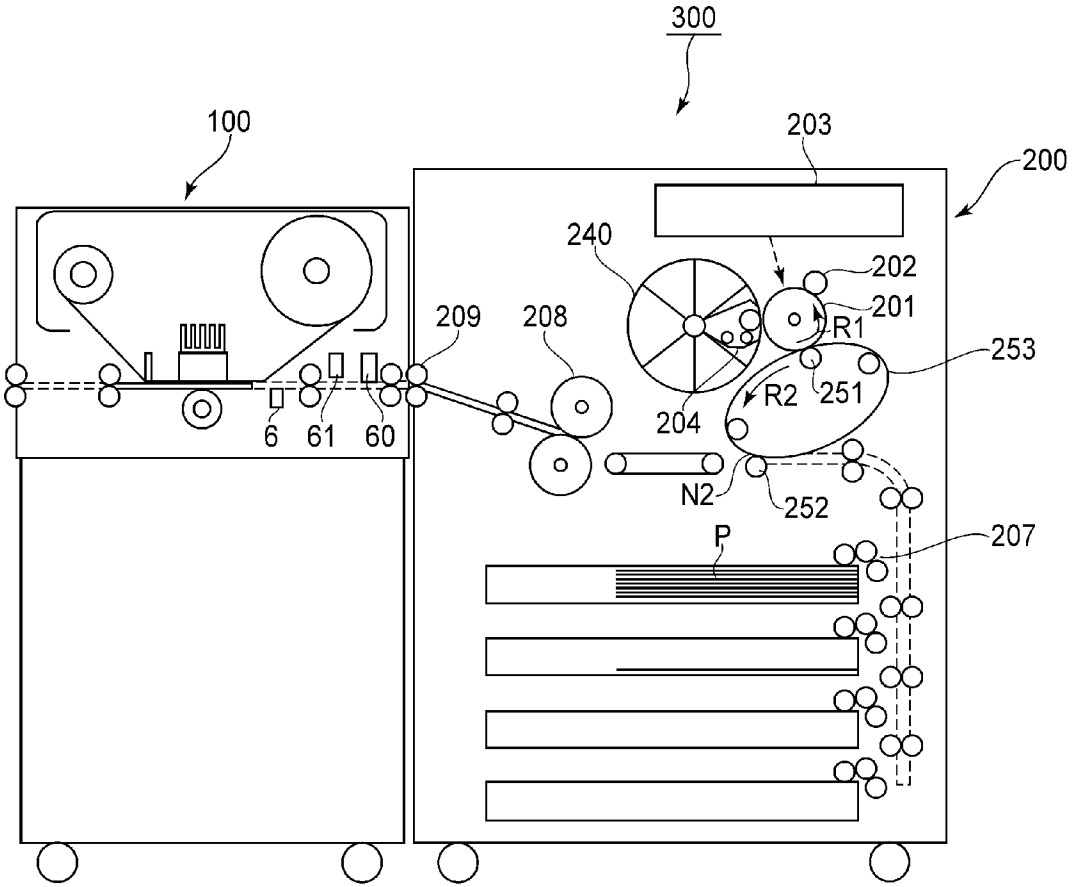
FIG. 11 is a schematic sectional view of the image formation system in accordance with the present invention, at a vertical plane parallel to the recording medium conveyance direction of the system.

FIG. 11 is a schematic sectional view of an image formation system 300 equipped with the surface processing apparatus 100 in the first embodiment of the present invention, and shows the overall structure of the system 300. In this embodiment, the surface processing apparatus 100 is connected to an electrophotographic image forming apparatus 200, making up an image formation system 300. The image formation system 300 electrophotographically forms an image on a sheet P of a recording medium, such as recording paper, with the use of thermally meltable toner, and delivers the finished print S (sheet P) to the surface processing apparatus 100, which is connected to the downstream side of the image forming apparatus 200 in terms of the direction in which the sheet P is conveyed. The surface processing apparatus 100 carries out the process for altering the print S (medium to be processed) in surface properties, and discharges the print S.

In this embodiment, the image forming apparatus 200 is of the so-called intermediary transfer type, and can electrophotographically form a full-color image. It has only one electrophotographic drum.

The image forming apparatus 200 has a photosensitive drum 201 which is an image bearing member, and is an electrophotographic photosensitive member (photosensitive member). The photosensitive drum 201 is rotationally driven in the direction indicated by an arrow mark R1. The image forming apparatus 200 has the following processing means, in the adjacencies of the peripheral surface of the photosensitive drum 201, being arranged in the order in which they will be described. The first one is a charge roller 202 as a charging means. The next one is an exposing device 203 (laser scanner) as an exposing means. The third one is a rotary developing device 240 equipped with multiple monochromatic developing devices 204 as developing means. The next one is an intermediary transfer unit as a transferring means. The last one is a drum cleaner as a means for cleaning the photosensitive member 201.

The intermediary transfer unit has an intermediary transfer belt 253, which is an endless belt as an intermediary transfer member. The intermediary transfer belt 253 is positioned so that its outward surface, in terms of the loop which the intermediary transfer belt 253 forms, faces the peripheral surface of the photosensitive drum 201. The intermediary transfer belt 253 is suspended and kept stretched by multiple rollers, and is circularly driven in the direction R2 in the drawing. Further, the intermediary transfer unit has a primary transfer roller 251 as a primary transferring means, which is on the inward side of the belt loop, opposing the peripheral surface of the photosensitive drum 201 with the presence of the intermediary transfer belt 253 between itself and photosensitive drum 201. The area of contact between the intermediary transfer belt 253 and peripheral surface of the photosensitive drum 201 is the primary transfer station N1 (primary transfer nip). Further, the intermediary transfer unit has a secondary transfer roller 252 as a secondary transferring means, which is placed on the outward side of the belt loop, in contact with the outward surface of the intermediary transfer belt 253. The area of contact between the secondary transfer roller 252 and intermediary transfer belt 253 is the secondary transfer station N2 (secondary transfer nip).

In this embodiment, the rotary developing device 240 has a developing device 204 which uses transparent toner (clear toner), in addition to the developing devices 204, which use cyan (C), magenta (M), yellow (Y) and black (K) toners, one for one. The surface processing apparatus 100 is an apparatus which gives a desired level of gloss to the surface of a print outputted by the image forming apparatus 200, by transferring the surface texture (surface properties) of its film 11 by reheating the toner image on the print. Therefore, if a given section of the print is relatively small in the amount of the toner thereon, it is difficult for the surface processing apparatus 100 to make the given section of the print satisfactorily glossy. However, the sections of the image, which are relative small in the amount of toner, blank sections of the image, and the like, can be altered in gloss by coating these sections with transparent toner. Incidentally, the transparent toner does not affect the full-color toner image in color.

The yellow (Y), magenta (M), cyan (C) and black (K) toners are made up of microscopic particles, the primary ingredients of which are resin and pigment. In comparison, the transparent toner is made up of microscopic particles, the primary ingredient of which is resin alone. That is, it does not contain pigment. In this embodiment, the primary resinous ingredient of the toner is polyester.

The image forming apparatus 200 has: a conveyance section 207 which conveys a sheet P of a recording medium; a fixation station 208 which fixes an unfixed toner image to a sheet P of recording medium; a discharging section 209 which conveys a print produced by the image forming apparatus 200, to the surface processing apparatus 100; etc.

The image forming apparatus 200 structured as described above can form a full-color image, which contains transparent toner, using the same image formation process as that used by an ordinary electrophotographic image forming apparatus. The image forming operation carried out by the image forming apparatus 200 to form a full-color image which contains transparent toner is as follows. In the operation, as the photosensitive drum 201 is rotationally driven, the peripheral surface of the photosensitive drum 201 is uniformly charged by the charge roller 202. Then, the charged area of the peripheral surface of the photosensitive drum 201 is scanned by (exposed to) the beam of laser light emitted by the exposing device 203 while being modulated with electrical signals which reflect one of four monochromatic color images into which the original multicolor image was separated. Thus, an electrostatic latent image (electrostatic image) that reflects the electric signals is formed on the peripheral surface of the photosensitive drum 201. The electrostatic latent image formed on the photosensitive drum 201 is developed into a monochromatic toner image by the developing device 204, which uses toner that corresponds in color to the monochromatic color image. Then, the monochromatic toner image formed on the photosensitive drum 201 is transferred (primary transfer) onto the intermediary transfer belt 253 by the function of the primary transfer roller 251. This sequence, made up of the charging process, the developing process, and the primary transferring process, is repeated for the number of times equal to the number of the monochromatic images into the original image was separated. Thus, four monochromatic toner images, different in color, are transferred in layers (primary transfer) onto the intermediary transfer belt 253, creating a multilayered toner images, or a full-color image. Then, the four monochromatic toner images, different in color, layered on the intermediary transfer belt 253 are transferred together (secondary transfer) onto a sheet P of the recording medium by the function of the secondary transfer roller 252. The sheet P of the recording medium is conveyed to the secondary transfer station N2 from the recording medium feeding section 207, with such timing that it arrives at the secondary transfer station N2 at the same time as the multiple toner images, different in color, layered on the intermediary transfer belt 253. Further, with the same timing as the timing described above, the secondary transfer roller 252 is placed in contact with the intermediary transfer belt 253. Then, the sheet P of the recording medium, on which the transferred toner images are present, is conveyed to the fixation station 208, and is conveyed through the fixation station 208 while being subjected to heat and pressure. Thus, the toner images are fixed to the sheet P of the recording medium. The toner remaining on the photosensitive drum 201 after the primary transfer is removed and recovered by the drum cleaner. As for the toner remaining on the intermediary transfer belt 253 after the second transfer, it is removed and recovered by an unshown cleaning means. Then, the sheet P of the recording medium having the fixed toner image is conveyed, as the print S to be processed by the surface processing apparatus 100, to the surface processing apparatus 100 by the discharging section 209 of the image forming apparatus 200.

The surface processing apparatus 100 is connected to the discharging section 209 of the image forming apparatus 200. Therefore, the delivery tray with which an ordinary image forming apparatus (200) is provided, and a sheet feeding device with which an ordinary surface processing apparatus (100) is provided, are not included in the image formation system 300 in this embodiment.

The structure of the surface processing apparatus 100 in this embodiment is practically the same as that of the surface processing apparatus 100 in the first embodiment, except that it is not provided with the cassette 9 and feed roller 3, with which the surface processing apparatus 100 in the first embodiment is provided. Thus, as an image is formed on a sheet P of recording medium by the image forming apparatus 200 in this embodiment, the sheet P is directly conveyed, as a medium S to be processed, into the surface processing apparatus 100. Further, in this embodiment, the controller 500 of the surface processing apparatus 100 is capable of communicating with the unshown controller (control section) of the image forming apparatus 200. Further, in this embodiment, the controller 500 can control the operation of each of the various sections of the surface processing apparatus 100, based on the gloss alteration data inputted from the image forming apparatus 200 and/or the gloss alteration data inputted through the control panel 170 with which the surface processing apparatus 100 is provided. The gloss alteration data includes the gloss alteration pattern (information about position of sections of print S (medium to be processed) to be heated) which is used for causing the thermal head 8 to selectively make its multiple heat generation resistors to generate heat, in synchronism with the timing with which the corresponding sections of the surface of the print S (medium to be processed), which are to be processed, are moved through the processing station T. The thermal head 8 makes its heat generating resistors which correspond to the sections of the print S (medium to be processed), based on the gloss alteration pattern, to process the surface of the print S (medium to be processed). Like the surface processing apparatus 100 in the first embodiment, the surface processing apparatus 100 in this embodiment may be structured so that the gloss alteration data can be inputted into the controller 500 by an external apparatus such as a personal computer.

As the print S, which is a combination of a sheet P of the recording medium and a full-color image which contains transparent toner, for example, is discharged from the print outlet 209 of the image forming apparatus 200, it is conveyed, as an medium to be processed, to the pair of conveyance rollers 4 of the surface processing apparatus 100. The gloss alteration process to which the print S (medium to be processed) is subjected after being conveyed into the surface processing apparatus 100 is the same as the one given as a part of the description of the first embodiment.

In a case where a print S (medium to be processed) is altered in gloss by the surface processing apparatus 100 which is connected to the print outlet side of the image forming apparatus 200, the gloss alteration performance of the surface processing apparatus 100 is desired to be higher than the image formation performance of the image forming apparatus 200. In a case where the gloss alteration performance of the surface processing apparatus 100 is lower than the image formation performance of the image forming apparatus 200, it is necessary to reduce the image forming apparatus 200 in image formation speed, or increase the image forming apparatus 200 in sheet interval, in order to match the performance of the image forming apparatus 200 with that of the surface processing apparatus 100.

Referring to FIG. 11, the CIS 60 is placed within the outer shell of the surface processing apparatus 100, which is separable from the outer shell of the image forming apparatus 200. However, this embodiment is not intended to limit the present invention in terms of the placement of the CIS 60. For example, the CIS 60 may be placed within the outer shell of the image forming apparatus 200, which is separable from the outer shell of the surface processing apparatus 200, and is positioned on the downstream side of the fixation station 208 in terms of the recording medium conveyance direction. That is, even if the CIS is positioned on the downstream side of the fixation station 208 in the outer shell of the image forming apparatus 200, the gloss alteration data can be modified by reading the image on the sheet P of the recording medium (print S (medium to be processed)), as in the first embodiment. Further, this placement of the CIS 60 has little to do with the fact that the image formation system in this embodiment is made up of the surface processing apparatus 100 which is in accordance with the present invention, and the image forming apparatus which forms an image on a sheet of the recording medium and delivers the resultant print, as an medium to be processed, to the surface processing apparatus 100.

Connecting the surface processing apparatus 100 to the print outlet 209 of the image forming apparatus 200 makes it possible to seamlessly move from image formation to image gloss alteration. Thus, the image formation system in this embodiment is significantly higher in productivity in terms of the formation of glossy image than a combination of an image forming apparatus, and a surface processing apparatus that is independent from the image forming apparatus.

The image forming apparatus with which the surface processing apparatus is in contact sometimes knows about the amount of difference in shape and/position of an image it forms, from the theoretically correct image. In such a case, the step for calculating the amount of image deformation and the step for calculating the amount of positional deviation can be eliminated by transferring the amount of image deformation and the amount of the positional deviation of the image from the image forming apparatus.

Further, a collating apparatus, a binding apparatus, and the like may be connected to the downstream side of the surface processing apparatus 100.

As described above, the image formation system 300 has: the surface processing apparatus 100; and the image forming apparatus 200 which produces a print S by forming an image on a sheet P of the recording medium, based on the information of the original image (image to be formed), and sends the print S (medium to be processed) to the surface processing apparatus 100.

That is, the present invention is applicable to an image formation system such as the one described above. The effects of the application are the same as those given in the description of the first embodiment.

(Miscellanies)

The preceding embodiments of the present invention were described with reference to the case in which the medium to be altered in surface properties was a print outputted by an electrophotographic image forming apparatus. Sometimes, however, it is desired to create a print which has gold, silver, or the like metallic appearance across its specific sections. However, an electrophotographic image forming apparatus forms an image by utilizing electrostatic force. In principle, therefore, it is difficult to use a metallic substance as a part of the material for the toner used by an electrophotographic image forming apparatus. In comparison, in the case of a thermal transfer printer, which uses a thermal head, it is possible to form an image which has a metallic appearance, by forming a metallic layer, as metallic ink, on film by vapor deposition, and thermally transferring the metallic ink onto a sheet of recording medium (Japanese Laid-open Patent Application 2001-130150). The film used by an image forming apparatus of the thermal transfer type has a substrate film, and an ink layer coated on the substrate film. In some cases, the ink layer is coated on the substrate film with the placement of a parting layer between the ink layer and substrate layer, and an adhesive layer is placed on the ink layer. When producing a print which has unusual color, such as gold color and silver color, across its specific sections with the use of a gloss altering apparatus, aligning a heating pattern with a print which is to be given unusual color, such as gold color and silver color, is very important. The present invention is also applicable to a gloss altering apparatus which uses printing film produced by vapor depositing ink of metallic color such as gold color and silver color, on the substrate film, and transfers ink of unusual color such as gold color and sliver color, onto specific sections of a prints outputted by an image forming apparatus. The application of the present invention to such an image forming apparatus makes it possible to desirably align the color transfer pattern, and the print to which the unusual color is to be given across its specific sections, as the gloss alteration pattern was precisely aligned with the print to be altered in gloss, in the first embodiment. In the present invention, the definition of the surface alteration process means not only selectively altering in gloss, various sections of the surface of an medium to be processed, but also, giving metallic appearance, such as metallic gloss, to the selected sections of the surface of the medium to be processed, by thermally transferring metal-colored ink onto the selected sections of the surface of the medium to be processed. That is, the surface processing apparatus 100 in accordance with the present invention can use such film that has a surface layer which is different in surface texture (roughness) from the surface layer of the medium to be processed, or such film that has a surface layer which is formed by coating the film substrate with ink transferable onto the surface of the medium to be processed, by being thermally melted. As described above, the present invention is applicable to a surface processing apparatus which is for selectively altering in surface properties (texture), various sections of the surface of an medium to be altered, by transferring the surface properties (texture) of film onto the surface layer of the medium by heating the surface of the medium through the film, and a surface processing apparatus which is for thermally transferring the thermally meltable ink on film, onto the selected sections of the surface of an medium to be processed. It is also applicable to an image formation system equipped with such a surface processing apparatus.

Incidentally, the image on a print (medium to be processed) and the contour of the recording medium of the print may be read by a camera (digital camera), instead of the CIS used as an image reading means in the first embodiment. Further, the description of the operational sequence, in this embodiment, for altering the gloss alteration data is the same as the one given as a part of the description of the first embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 203590/2011 filed Sep. 16, 2011, which is hereby incorporated by reference.

What is claimed is:

1. A control apparatus for controlling a surface processing apparatus including feeding means for feeding a medium-to-be-processed, and heating means for selectively heating different, with respect to a direction substantially perpendicular a feeding direction of the medium-to-be-processed, positions of a surface of the medium-to-be-processed through a film, wherein the heating means partially heats the surface of the medium-to-be-processed on which an image is formed in accordance with original image information, while the medium-to-be-processed is being fed by the feeding means, said apparatus comprising:

control means for controlling a heating of the heating means;

original image information inputting means for inputting the original image information to said control means;

reading means, provided upstream of a heating portion for heating the medium-to-be-processed by the heating means, for reading an outer configuration of the medium-to-be-processed and an image formed on the medium-to-be-processed and for inputting to said control means outer configuration information indicative of the outer configuration of the medium-to-be-processed and actual image information indicative of the image on the medium-to-be-processed; and heating position information inputting means for inputting to said control means heating position information indicative of a heating position on the medium-to-be-processed by the heating means, wherein said control means determines a difference between a position, on the medium-to-be-processed, of the image indicated by the original image information and a position, on the medium-to-be-processed, of the actually formed image on the medium-to-be-processed indicated by the outer configuration information and the actual image information, and for correcting inputted heating position information on the basis of information of the difference, and for controlling the heating of the heating means in accordance with the corrected heating position information.

2. An apparatus according to claim 1, wherein the information indicative of the difference relates to a degree of difference in at least one of an offset, a rotation, a deformation and a magnification between the original image information and the actual image information.

3. An apparatus according to claim 2, wherein said control means offsets, rotates, deforms or magnification-changes a heating pattern of the heating means to compensate for the difference.

4. An apparatus according to claim 1, further comprising side detecting means, provided upstream of the heating portion with respect to the feeding direction of the medium-to-be-processed, for detecting a side of the medium-to-be-processed, with respect to a direction substantially perpendicular to the feeding direction, and leading end detecting means, provided upstream of the heating portion with respect to the feeding direction, for detecting a leading end of the medium-to-be-processed with respect to the feeding direction, wherein said control means determines a heating starting position of the heating means on the basis of a detection result of said side detecting means, a detection result of said leading end detecting means and the corrected heating position information.

5. An apparatus according to claim 1, wherein said reading means reads the outer configuration and the image above medium-to-be-processed prior to start of the heating of the medium-to-be-processed by the heating means.

6. An apparatus according to claim 1, wherein a feeding distance of the medium-to-be-processed from an image reading position of said reading means to the heating position by the heating means is larger than a maximum length of the medium-to-be-processed measured in the feeding direction.

7. An image forming system comprising said control apparatus for controlling the surface processing apparatus according to claim 1 and an image forming apparatus for forming the image in accordance with the original image information on a recording material, which is fed to the surface processing apparatus as the medium-to-be-processed.

* * * * *